United States Patent [19]

Kadija et al.

[11] 4,081,350

[45] Mar. 28, 1978

[54] DIAPHRAGMS FOR USE IN THE ELECTROLYSIS OF ALKALI METAL CHLORIDES

[75] Inventors: Igor V. Kadija; Kenneth E. Woodard, Jr., both of Cleveland, Tenn.

[73] Assignee: Olin Corporation, New Haven, Conn.

[21] Appl. No.: 736,805

[22] Filed: Oct. 29, 1976

[51] Int. Cl.[2] ..... C25B 13/04; C25B 1/34

[52] U.S. Cl. ..... 204/296; 204/98; 204/295; 210/496

[58] Field of Search ..... 204/295, 296; 210/496

[56] References Cited

U.S. PATENT DOCUMENTS

| | | | |
|---|---|---|---|
| 1,291,253 | 1/1919 | Thatcher | 204/295 UX |
| 1,742,411 | 1/1930 | Muller | 204/295 UX |
| 3,093,583 | 6/1963 | Stoll | 210/496 X |
| 3,303,933 | 2/1967 | Huff | 210/441 |
| 3,413,239 | 11/1968 | Olstowski et al. | 204/295 UX |
| 3,702,267 | 11/1972 | Grot | 204/295 X |
| 3,796,314 | 3/1974 | Kolek | 210/321 |
| 3,923,630 | 12/1975 | Argade et al. | 204/266 |
| 3,980,613 | 9/1976 | Bachot et al. | 264/45.3 |
| 4,032,427 | 6/1977 | Kodija | 204/283 |

*Primary Examiner*—F.C. Edmundson

*Attorney, Agent, or Firm*—James B. Haglind; Donald F. Clements; Thomas P. O'Day

[57] ABSTRACT

A diaphragm for use in the electrolysis of alkali metal chloride solutions in elecrolytic diaphragm cells is comprised of a mixture of sand and a thermoplastic polymeric binding agent. The diaphragms may include a support material and an additive such as a lubricant. The diaphragms of the present invention have increased stability, a long operational life and are non-polluting.

10 Claims, No Drawings

DIAPHRAGMS FOR USE IN THE ELECTROLYSIS OF ALKALI METAL CHLORIDES

This invention relates to electrolytic diaphragm cells. More particularly, this invention relates to novel diaphragms for electrolytic diaphragm cells.

Production of chlorine and alkali metal hydroxides in diaphragm cells which electrolyze alkali metal chloride solutions has been a commercially important process for a number of years. The diaphragm cell employs an anode and a cathode separated by a fluid permeable diaphragm. Maintenance of the desired fluid permeability of the diaphragm is an economically desirable aspect in the operation of the diaphragm cell. While asbestos has been the primary material employed in diaphragms in commercial chlorine cells, there has been an extensive search for materials having improved cell life.

It is known to employ inorganic materials such as glass, sand or corundum in diaphragms for electrolytic cells where they are combined with a binding agent. Inorganic binders such as hydraulic cement are cited in, for example, U.S. Pat. Nos. 512,503, issued to Craney; 579,250, issued to Baker; and 609,745, issued to Luxton. These diaphragms were found to be defective because their density and bulkiness caused large power losses. British Pat. No. 312,713, issued to Mueller, teaches the use of organic materials such as rubber or qutta percha as well as cellulose and thermoplastic cellulose esters like cellulose nitrate. Cellulose esters, however, are readily decomposed when in contact with alkali metal hydroxide solutions. These diaphragms were readily replaced by asbestos compositions in commercial cells for the electrolysis of alkali metal chloride solutions.

The use of asbestos, however, produces diaphragms of limited cell life and in addition, asbestos has now become a suspected health hazard.

Therefore there is a need for diaphragms having increased operating life while employing materials which are inexpensive.

It is an object of the present invention to provide a diaphragm having increased stability and a longer operational life when employed in the electrolysis of alkali metal chloride solutions.

Another object of the invention is the use of non-polluting materials in diaphragm compositions.

A further object of the invention is the production of diaphragm having reduced costs for materials.

Briefly, the novel diaphragm of the present invention for use in the electrolysis of alkali metal chloride brines comprises a cohesive body formed of a mixture of sand and a thermoplastic polymeric binding agent.

The term sand includes compositions having a silicon dioxide content of at least about 95 percent by weight. Suitable sands include silica, quartz and silica sand among others.

It is desirable that the sand have a suitable particle size, for example, smaller than about 40 mesh and preferably from about 100 to about 200 mesh (Tyler Standard Screen Scale).

As a binding material a thermoplastic polymeric composition is employed which is resistant to the gases and solutions which are found in a cell for the electrolysis of alkali metal chloride solutions.

Examples of suitable thermoplastic polymeric binding agents are those produced from derivatives of petroleum or coal and include, for example, polyarylene compounds and polyolefin compounds.

Polyarylene compounds include polyphenylene, polynaphthylene and polyanthracene derivatives. For example, a useful group of binding agents are polyarylene sulfides such as polyphenylene sulfide or polynaphthylene sulfide. Polyarylene sulfides are well known compounds whose preparation and properties are described in the Encyclopedia of Polymer Science and Technology (Interscience Publishers) Vol. 10, pages 653–659. In addition to the parent compounds, derivatives having chloro-, fluoro- or alkyl substituents may be used such as poly(perfluorophenylene) sulfide and poly(methylphenylene) sulfide.

Polyolefin compounds suitable as binding agents include polymers of olefins having from 2 to about 6 carbon atoms in the primary chain, for example, polyethylene, polypropylene, polybutylene, polypentylene and polyhexylene, as well as their chloro- and fluoroderivatives such as polyvinyl chloride, polyvinylidene chloride, polytetrafluoroethylene, fluorinated ethylene-propylene (FEP), polychlorotrifluoroethylene, polyvinyl fluoride, polyvinylidene fluoride, copolymers of ethylenechlorotrifluoroethylene, and perfluoroalkoxy resins.

Thermoplastic polymeric binding agents are used in particulate forms such as granules or powders where the particle size is preferably smaller than 100 mesh and more preferably from about 150 to about 250 mesh.

In preparing the novel diaphragms of the present invention, any suitable proportions of sand and the thermoplastic polymeric binding agent may be employed. For example, mixtures comprising from about 10 to about 90 percent by volume of sand and from about 90 to about 10 percent by volume of thermoplastic polymeric binder may be employed. Preferably the diaphragms comprise mixtures of from about 30 to about 70 percent by volume of sand from about 70 to about 30 percent by volume of thermoplastic polymeric binding agent.

The sand and polymeric organic binder are blended as dry particles or in slurry form by known methods to produce a substantially homogeneous mixture.

It may be desirable to employ additives such as lubricants or wetting agents in the mixture.

Examples of lubricants include granular materials having a melting point above about 100° C. such as graphite, zinc stearate, calcium stearate, stearic acid, and synthetic amide waxes which are used in amounts of from about 0.25 to about 10 percent by volume of the total mixture of sand and binding agent. Where a conductive material such as graphite is added, the amount used is insufficient to make the diaphragm electrically conductive.

Suitable wetting agents include surface active agents such as alkyl aryl polyether alcohols which are used in amounts of about 0.5 percent to about 1 percent by volume of the mixture.

If desired, the mixture may contain other additives such as alumina, inorganic phosphates, lithium salts, lime or magnesia to provide improved ionic conductivity and cation exchange properties.

Diaphragms of the present invention are formed by melt processing the mixture, for example by heating at temperatures up to about 350° C. for a short period of time and cooling to form a cohesive shaped body having a porosity suitable for use in the electrolysis of alkali metal chlorides.

Where added mechanical support is desired, materials in the form of fibers, meshes or fabrics may be incorporated in the mixture. The materials are suitable for melt processing and may be non-conductive such as glass wool, polytetrafluoroethylene fabric or polytetrafluoroethylene staples or conductive including steel wool and meshes of nickel, steel, or titanium. In forming diaphragms containing conductive materials as mechanical support, care is taken to encapsulate the conductive material in the mixture to prevent the diaphragm from becoming electrically conductive.

Diaphragms of the present invention are very stable when employed in the electrolysis of alkali metal chloride solutions. They have an extended service life with little evidence of loss of flow properties due to plugging. The diaphragms are produced from non-polluting inexpensive materials using economical methods of production.

The porous diaphragms of the present invention are illustrated by the following examples without any intention of being limited thereby.

EXAMPLE 1

Sand (99 percent $SiO_2$), having a particle size smaller than 100 mesh, was added to a tumbler along with polyphenylene sulfide resin (Phillips Petroleum Company, Ryton-PPS type V-1, a polyphenylene sulfide resin) particles smaller than 200 mesh and graphite having a particle size of less than 100 mesh. The components were blended for about two hours to provide a mixture containing (by volume) 50 percent sand, 40 percent resin and 10 percent graphite. The mixture was poured into a mold and heated to a temperature of 330° C. Pressure was then applied (12 kg/cm$^2$) and the mixture allowed to cool down under pressure. Into an electrolytic cell containing brine having a sodium chloride concentration of 315–320 grams per liter, the porous shaped diaphragm was placed adjacent to the cathode. Electrolysis of the brine was conducted at a current density of 2 KA/m$^2$ for a period of 20 days to produce $Cl_2$ gas and sodium hydroxide at a concentration of 115–170 grams per liter at an average power consumption in the range of 2250–2700 kilowatt hours per ton of $Cl_2$. During the period of operation no evidence of plugging was found.

EXAMPLE 2

A homogeneous mixture was prepared containing 50 percent by volume of sand (99 percent $SiO_2$); 40 percent by volume of a resinous mixture of polyphenylene sulfide and polytetrafluoroethylene (available from Liquid Nitrogen Products Company under the trade name 2002-PPS); and 10 percent by volume of graphite. All components had a particle size of 100 mesh or less. Following blending, the mixture was placed in a mold along with a nickel mesh used as a support material (Exmet Corp. Distex brick 5 Ni 35-1/0) and heated in an oven to 350°–400° C. for about 30 minutes. After removal from the oven, a pressure of 12 kg/cm$^2$ was applied to the mold during the cooling period. The prepared diaphragm, 2–3 mm thick, was positioned adjacent to the cathode in a cell for the electrolysis of sodium chloride brines containing 315–320 grams per liter of NaCl. Brine at a temperature of 85°–90° C., was electrolyzed at a current density of 2 KA/m$^2$ of anode surface to produce chlorine gas and sodium hydroxide at a concentration of 135–170 grams per liter of NaOH and containing 160–190 grams of NaCl. The cell has been operating for 130 days, with an average power consumption in the range of 2300–2460 KWH/ECU. During the period of operation, with the anolyte head level maintained at about 2 inches, there has been no evidence of pluggage of the diaphragm.

EXAMPLE 3

A diaphragm of the type of Example 2 was produced and placed in a mold. A layer of the mixture of sand and polyphenylene sulfide used in Example 1, was placed on top of the diaphragm and the mold heated in an oven at 350°–400° C. for about ½ hour. After removal from the oven, pressure was applied during the cooling period and a layered diaphragm produced. The layered diaphragm was installed in a cell for the electrolysis of brine containing 315–320 grams per liter of NaCl and the head level maintained at about 3 inches. The diaphragm was positioned in the cell such that the top layer of sand and polyphenylene sulfide faced the anolyte. The cell was operated for 100 days at a current density of 2 KA/m$^2$. Chlorine gas and caustic soda (140–165 grams per liter NaOH) were produced at a power consumption in the range of 2400–2600 KWH/ECU. No evidence of diaphragm plugging was found during cell operation.

EXAMPLE 4

An aqueous slurry of polyphenylene sulfide resin (particle size smaller than 200 mesh) containing an octylphenoxy polyethoxy ethanol wetting agent (Rohm & Haas Triton X-100) was poured into a blade mixer. To the mixer was added sand, and graphite particles (smaller than 100 mesh) and the components mixed for about 1 hour. The slurry, containing (by volume) 50% sand, 40% polyphenylene sulfide, 9% graphite and 1% wetting agent was poured into a mold and let dry under natural convection. The mold was baked at 330° C. for about ½ hour and a diaphragm in the form of a cohesive shaped body produced.

What is claimed is:

1. A diaphragm for use in the electrolysis of alkali metal chloride brines which comprises a cohesive body formed of a mixture of sand and a polyarylene sulfide binding agent.

2. The diaphragm of claim 1 in which said mixture comprises from about 10 to about 90 percent by volume of said sand and from about 90 to about 10 percent by volume of said polyarylene sulfide binding agent.

3. The diaphragm of claim 1 in which said mixture contains a lubricant.

4. The diaphragm of claim 1 in which said mixture contains an electrically conductive support material selected from the group consisting of fibers, meshes and fabrics, said electrically conductive support material being encapsulated in said mixture.

5. The diaphragm of claim 2 in which said polyarylene sulfide compound is polyphenylene sulfide.

6. The diaphragm of claim 5 in which said mixture includes a lubricant.

7. The diaphragm of claim 6 in which said sand has a particle size smaller than about 40 mesh.

8. The diaphragm of claim 7 in which said polyphenylene sulfide has a particle size smaller than about 100 mesh.

9. The diaphragm of claim 8 in which said mixture comprises from about 10 to about 90 percent by volume of said sand and from about 90 to about 10 percent by volume of said polyphenylene sulfide.

10. The diaphragm of claim 9 in which said lubricant is granular graphite.

* * * * *